US006097350A

United States Patent [19]

Saucier

[11] Patent Number: 6,097,350

[45] Date of Patent: Aug. 1, 2000

[54] ANTENNA FOR RECEIVING SATELLITE SIGNALS

[76] Inventor: Marcel Saucier, P.O. Box 3043, Malartic, Canada, J0Y 1Z0

[21] Appl. No.: 09/178,975

[22] Filed: Oct. 26, 1998

[30] Foreign Application Priority Data

Dec. 18, 1997 [CA] Canada ..... 225225

[51] Int. Cl.[7] ..... H01Q 15/14

[52] U.S. Cl. ..... 343/912; 343/840

[58] Field of Search ..... 343/912, 914, 343/915, 916, 840; H01Q 15/14, 19/12

[56] References Cited

U.S. PATENT DOCUMENTS

| | | | |
|---|---|---|---|
| 4,201,991 | 5/1980 | Vines | 343/915 |
| 4,355,317 | 10/1982 | Mazio | 343/840 |
| 4,692,771 | 9/1987 | Rothbarth et al. | 343/882 |
| 5,061,945 | 10/1991 | Hull et al. | 343/840 |
| 5,104,211 | 4/1992 | Schumacher et al. | 343/912 |
| 5,291,212 | 3/1994 | Cox | 343/840 |
| 5,434,586 | 7/1995 | Kinoshita et al. | 343/840 |
| 5,539,421 | 7/1996 | Hong | 343/895 |
| 5,543,811 | 8/1996 | Chethik | 343/844 |
| 5,576,722 | 11/1996 | Bustillos | 343/882 |
| 5,686,923 | 11/1997 | Schaller | 343/700 MS |
| 5,847,681 | 12/1998 | Faherty et al. | 343/700 MS |

*Primary Examiner*—Hoanganh Le
*Attorney, Agent, or Firm*—Welsh & Katz, Ltd.

[57] ABSTRACT

A non-mobile antenna for receiving non-geostationary satellite signals comprised of a plurality of supporting members and rods is adapted with an upper and a lower array of reflecting members focusing the signals on a focal axis for processing.

5 Claims, 3 Drawing Sheets

ANTENNA FOR RECEIVING SATELLITE SIGNALS

The present invention relates generally to dish antennas. More particularly, the present invention relates to an antenna which is adapted to receive satellite signals in view of the position of such satellite.

BACKGROUND Of THE INVENTION

In recent years the use of parabolic reflector satellite antenna systems has been common and well documented. Dish shaped antennas are often used to either transmit energy toward a distant location or to receive energy from a distant location.

Many of those systems are created for use in a fixed location. Such so called stationary systems generally provide for a parabolic reflector portion to remain substantially in a fixed operating position with the possibility to aim the dish at a particular satellite when and if needed. These systems are adapted to be used in combination with geo-stationary satellites.

The type of antennas employing a torus face or similar device as a reflector can be very problematic since they are known to be very expensive to manufacture and difficult to install and adjust. Since the general direction of the antenna must be set in order to ensure that sufficient receiving sensitivity is obtained for the incoming satellite signals, it is important that this be done right upon initial installation of the antenna.

It follows that an even more difficult problem exists in providing an antenna system for mobile use as much as such systems need to be portable, possibly collapsible and compact for storage while in transport, yet readily usable with a minimum amount of assembly.

Grid-type antennas have been known for years and offer a certain number of advantages over fill reflecting surface antennas in that they provide low wind loads, and making them easily shipped in disassembled form. One of the problems with grid-type antennas made-up of numerous parts has been however the time required to assemble them due to the many steps involved.

SUMMARY OF THE INVENTION

The present invention overcomes the above shortcomings.

A primary object of the present invention is to provide a structure that is relatively simple, can be made available in kit form for easy erection and disassembly and is economic and relatively simple to manufacture and use.

Another object of the present invention is to provide an improved antenna which comprises a relatively small number of parts to be assembled.

Another object of the present invention is to provide an antenna which is easily adapted for operation relative to the position of the transmitting satellite.

Still another object of the present invention is to provide a relatively lightweight antenna which is compact and made-up of a plurality of substantially identical pre-shaped sector sets.

In accordance with yet another object of the present invention there is provided an antenna for receiving satellite signals comprising: a) a base; b) a plurality of supporting members; c) an array of rods; d) reflecting members extending diametrically across said supporting members, said reflecting members comprising an upper array and a lower array of members; e) a focal axis; whereby a satellite signal is received by the upper array reflecting members before being deflected towards the lower array of reflecting members then ultimately deflected and transmitted to the focal axis for processing.

In accordance with another object of the present invention there is provided an antenna for receiving satellite signals comprising: a) a base; b) a plurality of supporting members; c) an array of rods; d) reflecting members extending diametrically across said supporting members; e) a focal axis; whereby a satellite signal is received by an array of reflecting members then deflected and transmitted to the focal axis for processing.

In accordance with still another object of the present invention there is provided non-mobile antenna for receiving satellite signals from a non-geo-stationary satellite comprising: a) a base; b) a plurality of supporting members; c) an array of rods; d) reflecting members extending diametrically across said supporting members; e) a focal axis; whereby a satellite signal is received by an array of reflecting members then deflected and transmitted to the focal axis for processing.

In accordance with still yet another object of the present invention there is provided a kit for making an antenna comprising: a) a base; b) a plurality of supporting members; c) reflecting members; d) a focal axis; e) connecting means for connecting adapted members a) to e); whereby an antenna for receiving satellite signals is formed.

Further objects and advantages of the present invention will be apparent from the following description, wherein preferred embodiments of the invention are clearly shown.

BRIEF DESCRIPTION OF THE DRAWINGS

The present invention will be further understood from the following description with reference to the drawings in which.

DETAILED DESCRIPTION OF THE INVENTION

Referring now in detail to the drawings wherein like numerals refer to like parts throughout the various views, 10 is an antenna composed of five basic elements which can be easily assembled in order to form the structure of the present invention.

These elements are a regular base, the main supporting members 11, rods and members extending from the base to hold things together, the focal axis 13 and the reflecting members 14, which are in turn held together with the use of suitable connecting members.

The antenna of the present invention differs from the non-mobile antennas often used in combination with geo-stationary satellites in that this non-mobile antenna is to be used in combination with non-geo-stationary mobile satellites. There is no need for the antenna of the present invention to follow the path of the mobile (non-geo-stationary) satellite since the shape of its focal axis 13 allows for reception of the satellite waves from morning to night without the need for movement on the part of the antenna. The focal axis 13 is ellipsoid in shape thereby following the trajectory of the satellite and its signals.

Figure 1:
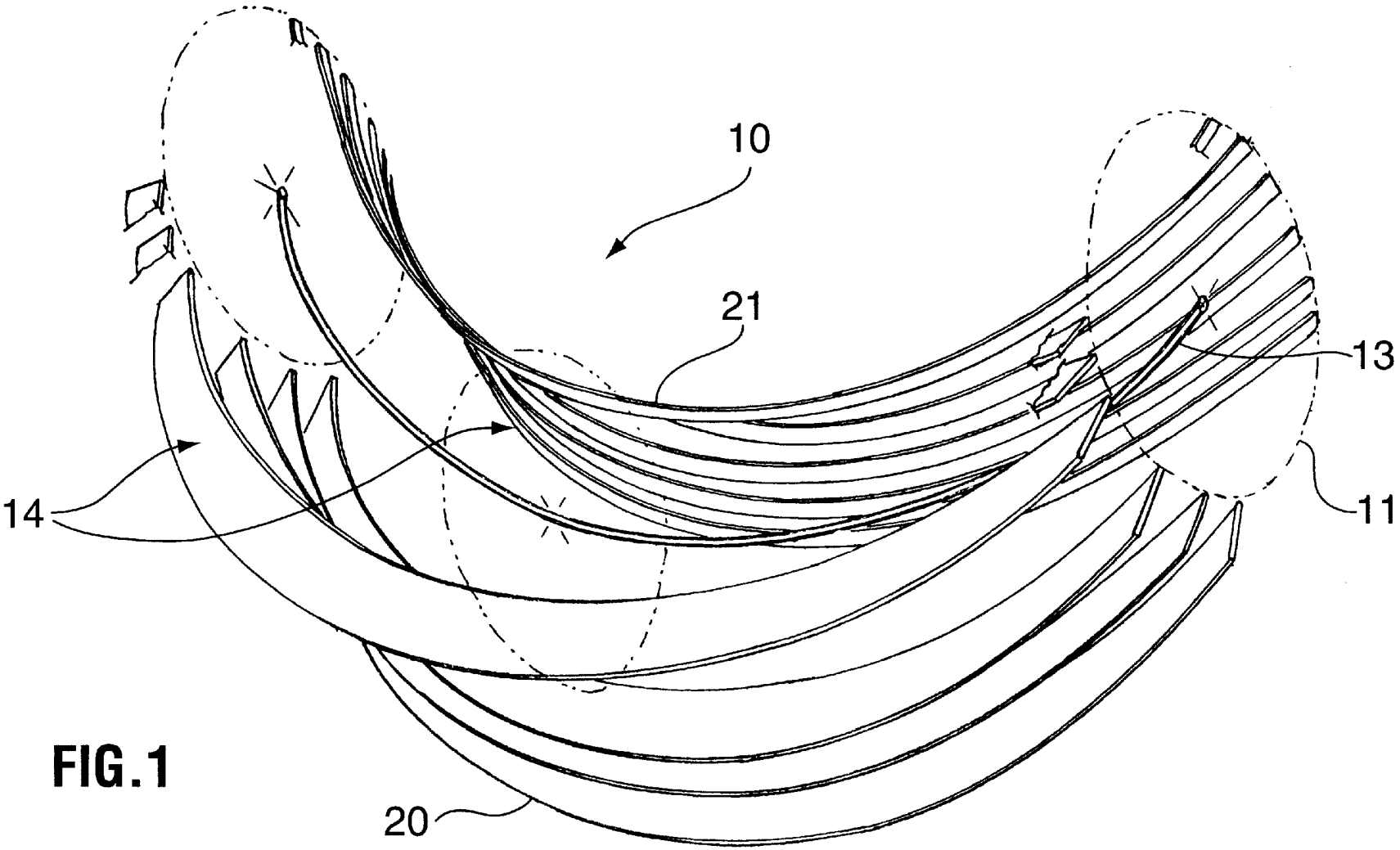
FIG. 1 is a perspective view of an antenna embodying the present invention.
Figure 2:
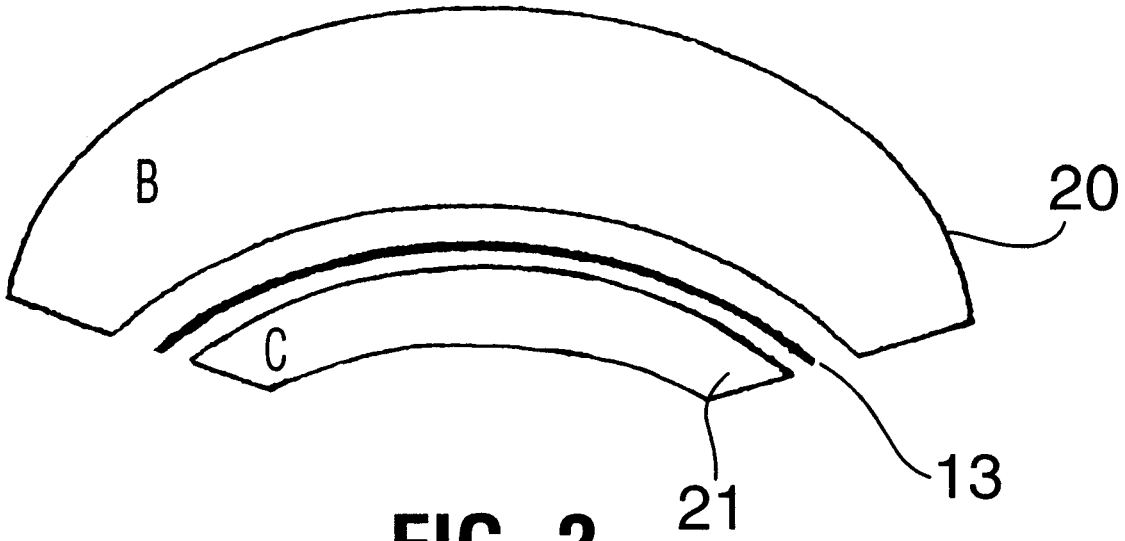
FIG. 2 is a top plan view of the reflecting members of the present invention.

A grid-like antenna is formed by an array of rods which are held in place from the base and ultimately attaching to the supporting members 11 therefore the antenna per se. Extending diametrically across the supporting members 11 are the reflecting members 14, which members 14 are really made up of an upper array of reflecting members 20 and a lower array of reflecting members 21, which members 20 and 21 (as illustrated in FIG. 2) can be flat or slightly concave, and form a grid-like pattern resembling the latitude/longitude pattern of the earth system depending on one's view point. The reflecting members 14 surround the focal axis 13 thereby concentrating and focalising the satellite signals on said focal axis.

As is well known, the spaces between the similar members 20 and 21 must be related to the wavelength of the signal to be received (microwave length for instance) at the operating frequency of the antenna.

The antenna will be better able to receive and concentrate the satellite signals by slightly adjusting the antenna according to the time of year, the signals hitting in a perpendicular fashion although it should be understood that this is not strictly necessary.

Figure 3:
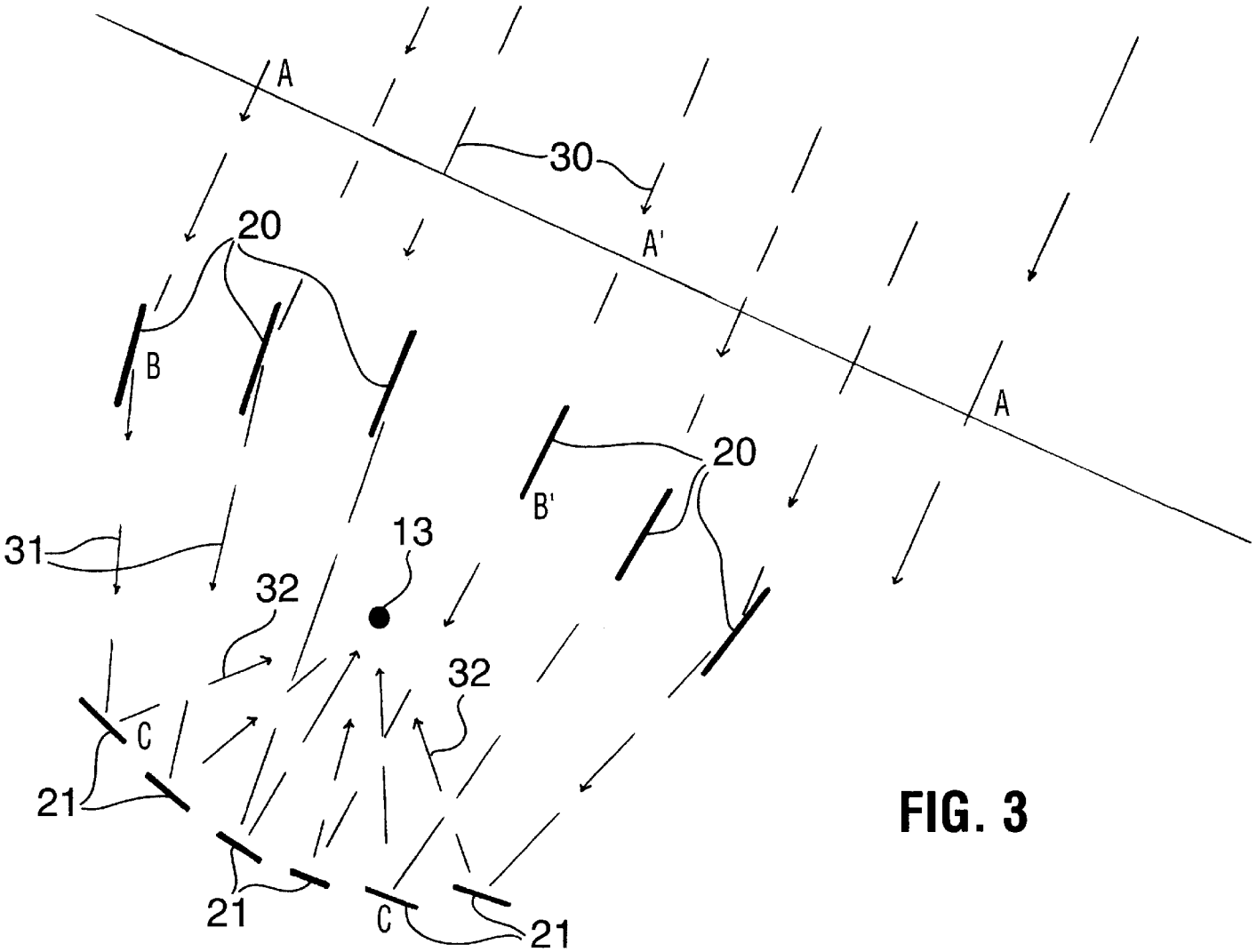
FIG. 3 is a schematic illustrating the workings of the present invention.

As can be seen in FIG. 3 where A/A' represents an arbitrary line, the signals 30 are first received by members 20 before being deflected 31 towards members 21, which are usually smaller in size, which then deflect, relative to the focal axis 13, the signals towards 32, the focal axis 13 for processing of said signals according to techniques know in the art. As a result ABC=A'B'C' since covering the same distances and thereby arriving in phase. It can be seen that by simply moving, though this is not strictly necessary for the purpose of the workings of the invention, the antenna according to the time of year when one wants to use the antenna that improved reception of the signals may potentially be achieved since the original angle of the signals when hitting the upper members 20 can be radically improved. Also, this will make it easier to ensure that the plane of symmetry of the antenna will be coincident with a plane identified by three points, being the antenna aiming line, the satellite, and the antenna receiving point.

It should be noted that it might be possible to adapt a one-piece lower array 21, instead of the multiple members now illustrated, which could be semi-cylindrical in shape and which could function such as a parabolic mirror.

Also, it would be possible for the antenna to function with a lower array of members 21 only, though one might lose in efficiency and performance.

This invention may readily be adapted to larger or smaller embodiments which may use fewer or more parts, mainly with respect to members 20 and 21. It should also be noted that the invention can be made available as a kit since the antenna of the present invention is easily adaptable to a range of sizes and number of parts used, and is easily put together. Also, the shape of members 20 and 21 make for easy packing and storage.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

The embodiments of the invention in which an exclusive property or privilege is claimed are defined as follows:

1. An antenna for receiving signals from a satellite comprising:

a) a plurality of supporting members;

b) an array of reflective members each of said members having a flat surface;

c) said reflecting members extending diametrically across said supporting members, said reflecting members comprising an upper array spaced from a lower array of members;

d) a focal axis that follows the trajectory of the satellite and the signals;

e) said upper array and said lower array parallel to and surrounding said focal axis;

whereby a satellite signal is received by the upper array reflecting members before being deflected towards the lower array of reflecting members then deflected and transmitted to the focal axis for processing.

2. The device of claim 1 wherein the focal axis is ellipsoid in shape.

3. A stationary antenna for receiving satellite signals from a non-geo-stationary satellite comprising:

a) a plurality of supporting members;

b) an array of reflecting members extending diametrically across said supporting members;

c) said reflecting members comprising an upper array of reflecting members spaced form a lower array of reflecting members;

d) a focal axis;

e) said upper and lower array of reflecting members being parallel to one another and surrounding said focal axis;

whereby a satellite signal is received by an array of reflecting members then deflected and transmitted to the focal axis for processing.

4. The device of claim 3 wherein the reflecting members are either flat or concave.

5. The device of claim 3 wherein the focal axis is ellipsoid in shape.

* * * * *